US007418913B2

(12) United States Patent
Dowd

(10) Patent No.: US 7,418,913 B2
(45) Date of Patent: Sep. 2, 2008

(54) EXTENDABLE RETRACTABLE PORTABLE WATERCRAFT MOORING SYSTEM

(76) Inventor: Robert A. Dowd, Box 407, Arborg (CA) R0C 0A0

( * ) Notice: Subject to any disclaimer, the term of this patent is extended or adjusted under 35 U.S.C. 154(b) by 0 days.

(21) Appl. No.: 11/686,032

(22) Filed: Mar. 14, 2007

(65) Prior Publication Data

US 2007/0151497 A1 Jul. 5, 2007

Related U.S. Application Data

(60) Provisional application No. 60/823,525, filed on Aug. 25, 2006.

(51) Int. Cl.
*B63B 21/00* (2006.01)

(52) U.S. Cl. ..... 114/230.17; 114/219

(58) Field of Classification Search ..... 114/230.1, 114/230.11, 230.15, 230.16, 230.17, 230.18, 114/230.19, 230.26, 230.27, 219, 221 R; 280/490.1, 491.1, 491.2
See application file for complete search history.

(56) References Cited

U.S. PATENT DOCUMENTS

| | | | | |
|---|---|---|---|---|
| 3,406,651 | A * | 10/1968 | Jalbert | 114/230.17 |
| 3,863,591 | A * | 2/1975 | Wild | 114/230.26 |
| 5,046,442 | A * | 9/1991 | Hay | 114/230.17 |
| 5,243,926 | A * | 9/1993 | Wright et al. | 114/230.19 |
| 5,408,946 | A * | 4/1995 | Jones et al. | 114/230.1 |
| 7,089,877 | B1 * | 8/2006 | Hay | 114/230.17 |

* cited by examiner

*Primary Examiner*—Lars A Olson
(74) *Attorney, Agent, or Firm*—Ryan W. Dupuis; Adrian D. Battison; Michael R. Williams

(57) ABSTRACT

A kit features two arm assemblies, each of which features a longitudinal member with a padded portion extending from proximate one end thereof toward the other end and a connection at each end allowing horizontal and pivotal motion of the arm assembly about. A method of mooring a watercraft involves connecting each arm assembly between a respective connection point on the watercraft and a respective securing point on a body distinct therefrom, allowing horizontal pivoting of the arms to horizontally move the watercraft toward a vertical plane in which the securing points lie and blocking further horizontal pivoting of the arms by contact between the watercraft and a respective one of the arm assemblies before the watercraft reaches the vertical plane. The arm assemblies bind due to contact with the watercraft, thereby blocking impact of the watercraft with the body to which the securing points are mounted.

20 Claims, 7 Drawing Sheets

EXTENDABLE RETRACTABLE PORTABLE WATERCRAFT MOORING SYSTEM

This application claims the benefit under 35 U.S.C. 119(e) of U.S. Provisional Application Ser. No. 60/823,525, filed Aug. 25, 2006.

FIELD OF THE INVENTION

This invention relates to a system for mooring a watercraft, and more particularly to a portable mooring system that doesn't require the installation of specialized mounting brackets at a mooring site.

BACKGROUND OF THE INVENTION

A number of arm-like mooring devices have been developed to secure watercraft to a dock but maintain a distance between the watercraft and dock to prevent damage that otherwise may be caused by impact therebetween. Such devices may be seen in U.S. Pat. No. 5,243,926 of Wright et al., U.S. Pat. No. 6,561,113 of Leise, U.S. Pat. No. 4,686,926 of Vance, U.S. Pat. No. 4,913,078 of Haverly and U.S. Pat. No. 5,450,808 of Beagan.

Prior art mooring devices may be limited in their portability by requiring the installation of a particular mounting mechanism on the watercraft and the dock or other structure to which the watercraft is to be secured. As result, the use of such a mooring device on more than one watercraft or at more than one mooring site may require multiple devices or at least the installation of multiple mounting brackets.

SUMMARY OF THE INVENTION

According to a first aspect of the invention there is provided a kit comprising two arm assemblies, each arm assembly comprising:

a longitudinal element having opposite first and second ends and comprising a padded portion extending from proximate the first end toward the second end;

a first connector supported at the first end of the longitudinal element, the first connector being arranged to allow horizontal and vertical pivotal motion of the arm assembly; and a second connector at the second end opposite the first connector, the second connector being arranged to allow horizontal and vertical pivotal motion of the arm assembly.

Preferably the longitudinal element of each arm assembly is extendable and retractable between an extended state and a collapsed storage state.

Preferably the longitudinal element of each arm assembly comprises a plurality of telescopically arranged hollow tube sections lockable in each of the extended and collapsed states.

Preferably the telescopically arranged hollow tube sections are lockable by cooperation of a locking pin with holes in the tube sections that align in the extended and collapsed states.

Preferably each of the first and second connections comprises a quick-release connection.

Preferably each quick-release connection comprises a carabiner.

Preferably the padded portion of each arm assembly comprises resilient material wrapped about at least a portion of the longitudinal element, for example one of the hollow tube sections.

There may be provided attachments each defining a receiver engageable to the first connection of a respective one of the arm assemblies.

Preferably the kit is used in combination with a watercraft and two securing points horizontally spaced along a vertical plane, the first connectors of the arm assemblies being connected to the watercraft at horizontally spaced receivers thereon and the second connectors of the arm assemblies being connected to the securing points. The horizontally spaced receivers may be pre-existing or defined by securing the attachments to the watercraft.

Preferably the padded portion of each arm assembly is at least partially disposed in an elevation range defined by a height profile of the watercraft.

Preferably horizontal pivoting of the arm assemblies, in each of clockwise and counterclockwise directions, allows movement of the watercraft toward the vertical plane in which the securing points lie, and contact between the watercraft and the padded portion of a respective one of the arm assemblies blocks the horizontal pivoting before the watercraft reaches the vertical plane.

The arm assemblies may be connected to the watercraft at opposite ends thereof. Alternatively, the arm assemblies may be connected to the watercraft at a common end thereof.

The watercraft may be a personal watercraft.

Each arm assembly may be connected to a hull of the watercraft.

In horizontal motion, the combination acts somewhat like a four-bar linkage with two pivot points provided on the watercraft and the other two at the securing points. However, horizontal pivoting of the arm assemblies in each direction is limited by eventual contact between the watercraft and a padded portion one of the arms. As the arms cannot pivot passed a certain point due to jamming against the watercraft, the watercraft is prevented from reaching any structure on which the securing points are supported. This prevents collision with the structure, for example with a dock, which could potentially damage the watercraft. This unique binding action of the system allows the watercraft to float free at a safe distance from the dock. Vertical pivoting of the arms allows the watercraft to rise and fall with water surface changes/disturbances such as wakes, tides and waves.

The device is extendable, retractable and portable. This allows the device to be collapsed and placed into storage on even small watercraft, and later removed for use at a moments notice at any location having a mooring ring, cleat or other bar/ring-like structure of suitable size.

According to a second aspect of the invention there is provided a method of mooring a watercraft, the method comprising the steps of:

providing first and second horizontally spaced connection points on the watercraft;

providing first and second securing points on a body separate and distinct from the watercraft, the securing points being horizontally spaced within a vertical plane;

connecting a first arm assembly between the first connection point on the watercraft and the first securing point such that said first arm assembly is pivotable in vertical and horizontal directions at the first connection and securing points;

connecting a second arm assembly between the second connection point on the watercraft and the second securing point such that said second arm assembly is pivotable in vertical and horizontal directions at the first connection and securing points;

horizontally pivoting the arms in one of clockwise and counterclockwise directions to horizontally move the watercraft toward to the vertical plane in which the securing points lie; and blocking further horizontal pivoting of the arms in the one direction by contact between the watercraft and a respective one of the first and second arm assemblies before the watercraft reaches the vertical plane in which the securing points lie.

Preferably there is provided the step of extending each arm assembly from a collapsed storage state before connecting the arm assembly.

Preferably there is provided the step of providing each arm assembly with padding about a portion thereof before connecting each arm assembly to prevent damage to the watercraft during contact with the arm assembly.

BRIEF DESCRIPTION OF THE DRAWINGS

In the accompanying drawings, which illustrate an exemplary embodiment of the present invention.

DETAILED DESCRIPTION

Figure 2:
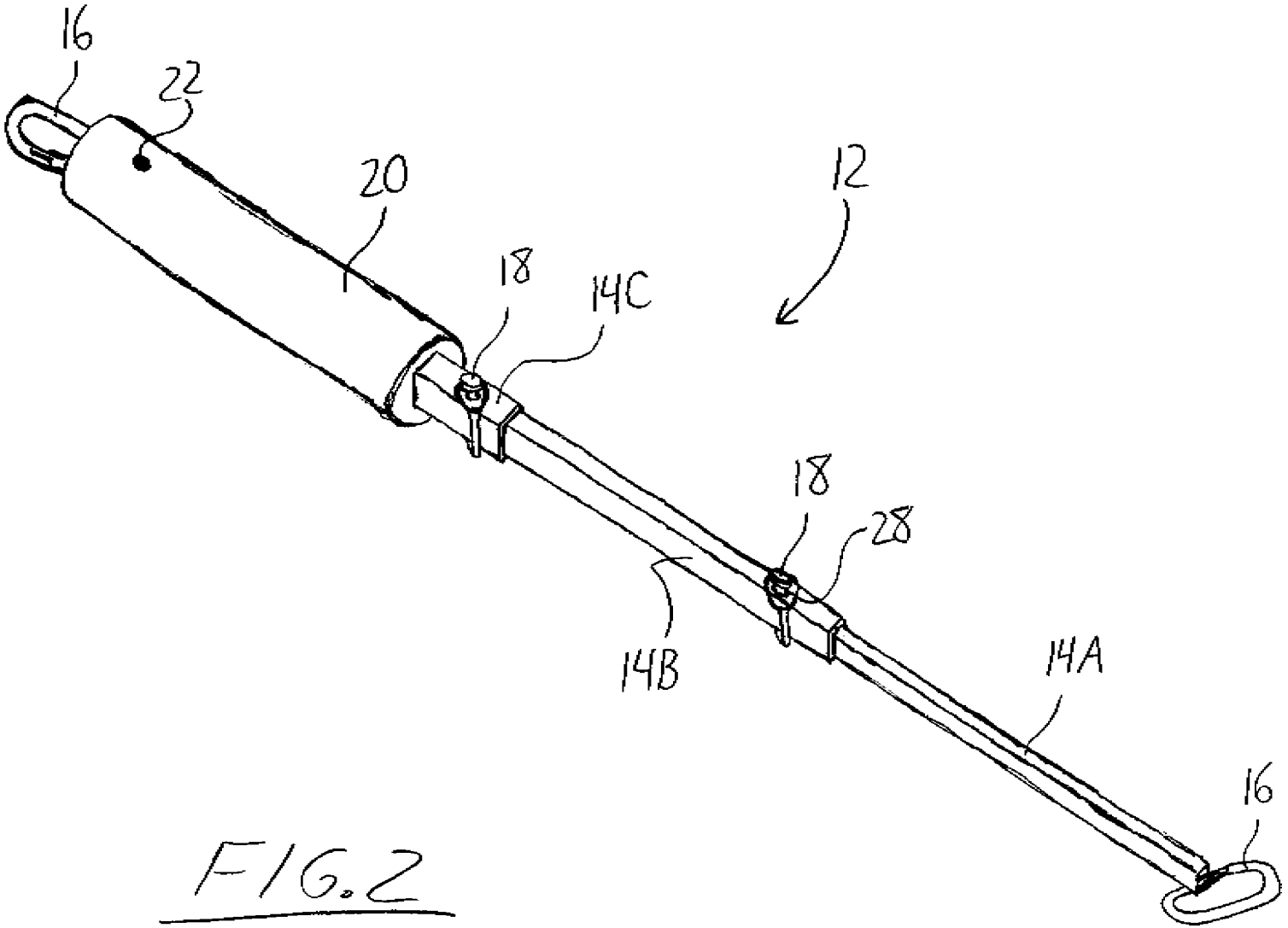
FIG. 2 is a perspective view of the arm assembly of FIG. 1 in an extended state for mooring a watercraft.
Figure 3:
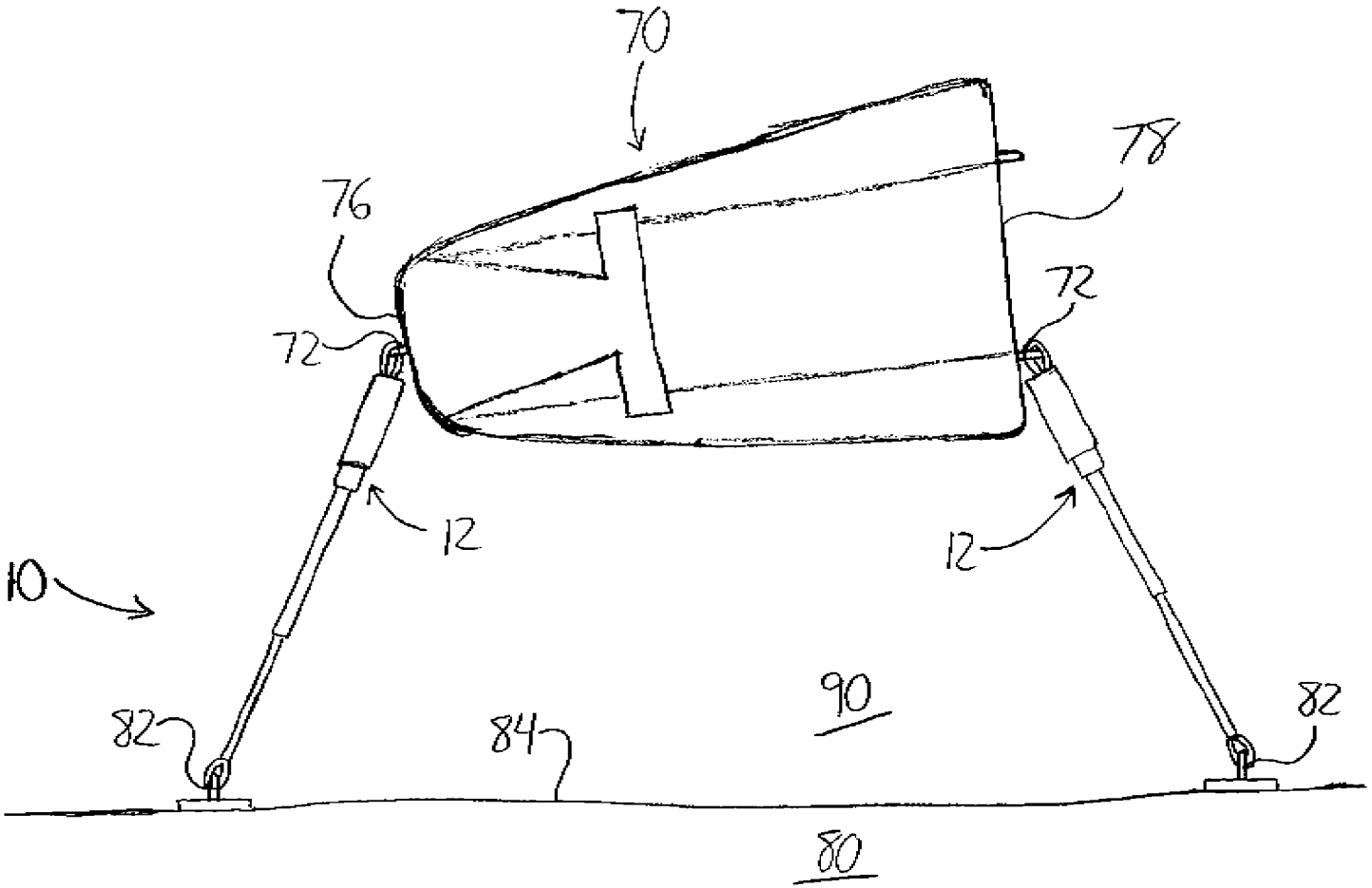
FIG. 3 is an overhead plan view of the mooring system connected to a dock and opposite ends of a watercraft with the mooring system in a free state allowing motion of the watercraft under pivoting of the arm assemblies either clockwise or counter-clockwise in a horizontal plane.
Figure 4:
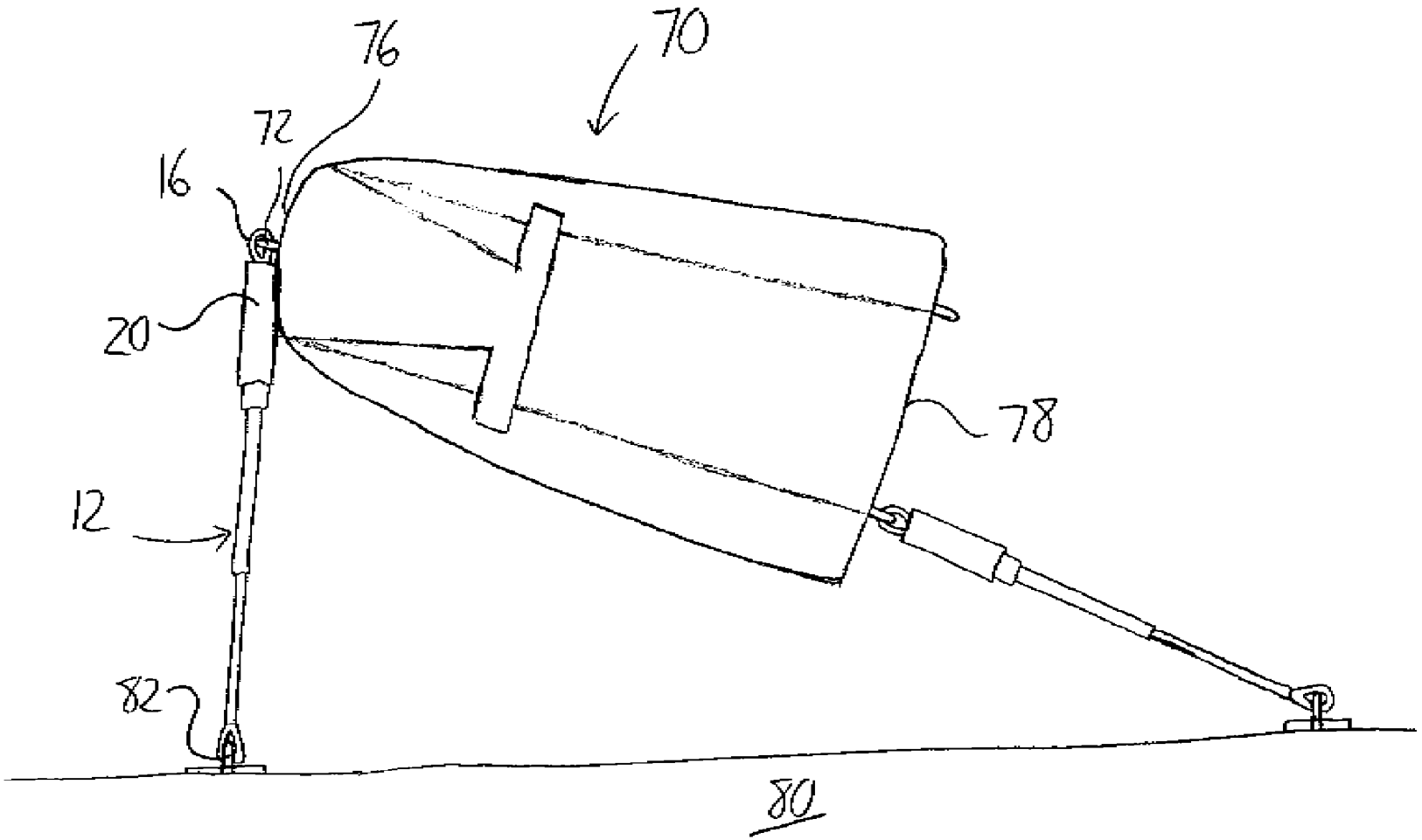
FIG. 4 shows the arm assemblies of FIG. 3 having undergone counter-clockwise pivotal motion to achieve a bound state of the mooring system in which further counter-clockwise pivotal motion of the arms is blocked to prevent the watercraft from reaching the dock.
Figure 5:
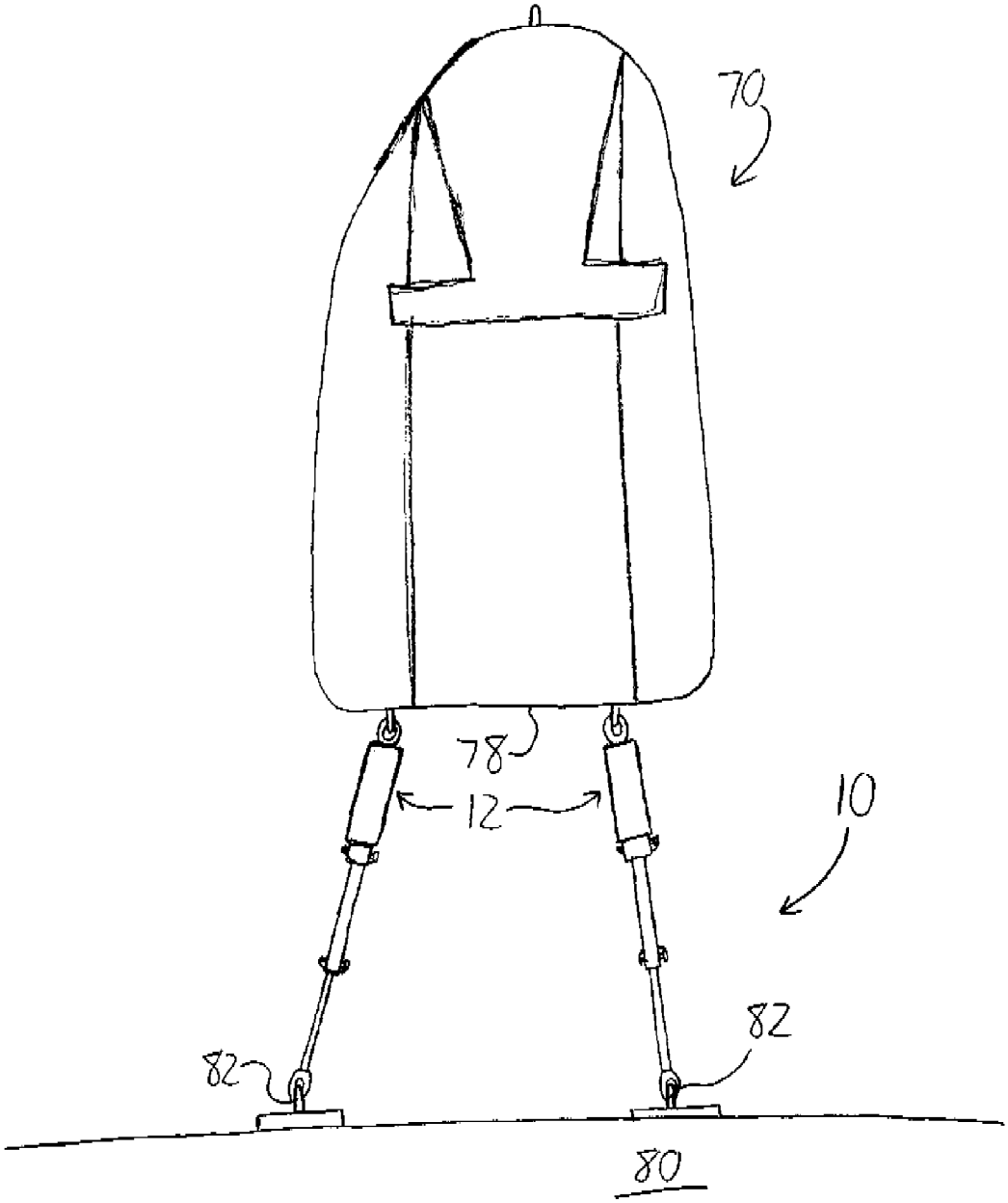
FIG. 5 is an overhead plan view of the mooring system connected to a dock and a single end of a watercraft with the mooring system in a free state allowing motion of the watercraft under pivoting of the arm assemblies either clockwise or counter-clockwise in a horizontal plane.
Figure 6:
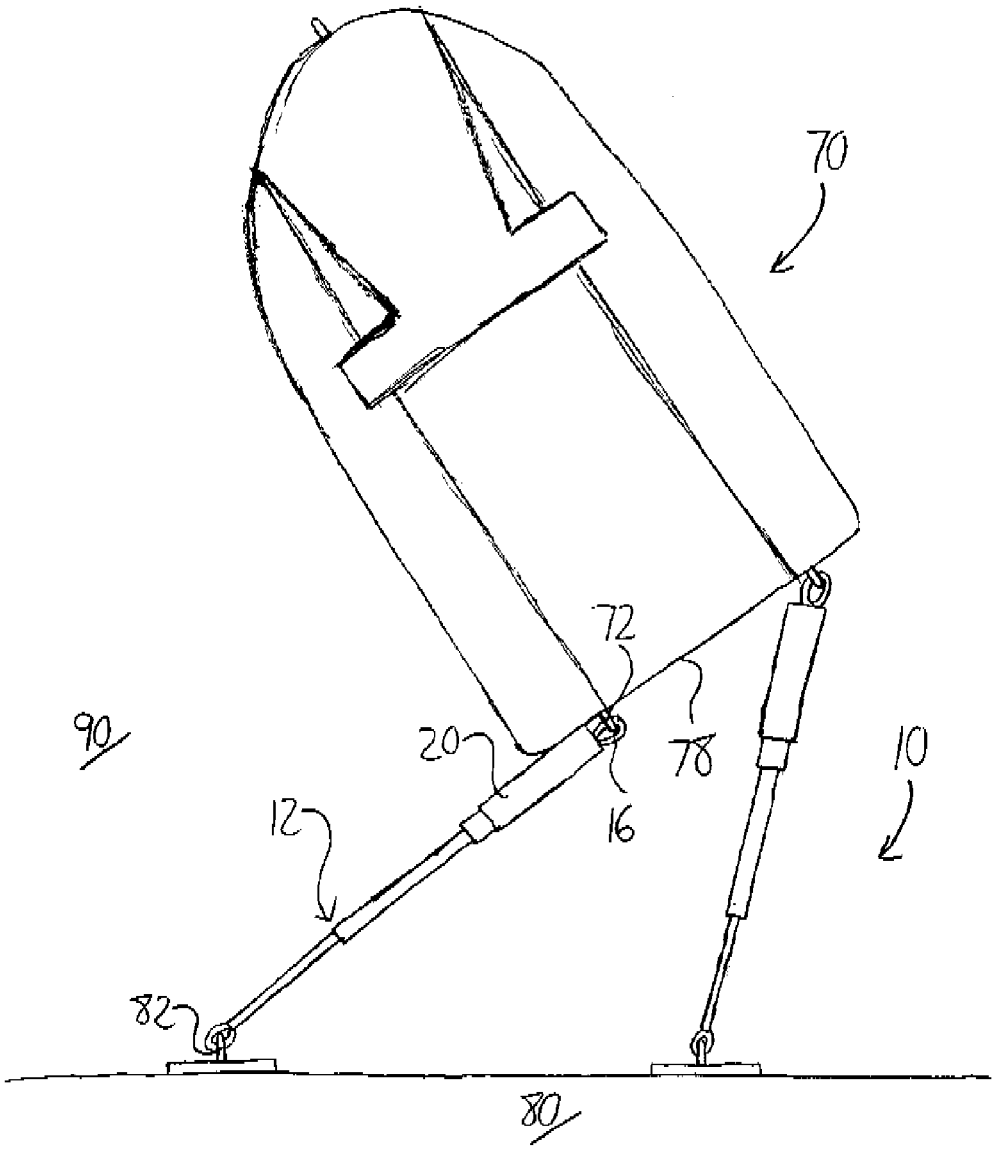
FIG. 6 shows the arm assemblies of FIG. 3 having undergone clockwise pivotal motion to achieve a bound state of the mooring system in which further clockwise pivotal motion of the arms is blocked to prevent the watercraft from reaching the dock.

FIGS. 2 to 7 show a portable mooring system 10 according to the present invention being used to secure a watercraft 70 to a dock 80 and prevent contact between the two. The system 10 features a pair of arm devices 12 that cooperate with the watercraft 70 and dock 80 to act somewhat like a planar four-bar linkage. Unlike a prior art mooring arm that is mounted to eliminate or block pivoting in a horizontal plane in order to maintain a distance between the dock and watercraft through the use of specialized mounting brackets on the dock or watercraft, the present invention uses a pair of arms 12 featuring simple connections that allow pivoting in both vertical and horizontal planes. While the pair of arms 12 can pivot horizontally, they are limited in the amount of pivoting in clockwise and counter-clockwise directions by eventual contact between the watercraft 70 and one of the arm devices 12. As shown in FIGS. 4 and 6, this contact limits movement of the watercraft toward the dock to prevent an impact and possible resulting damage. The vertical pivoting allows up and down motion of the watercraft, for example in response to wave and tidal activity, as already known in the prior art. While the mooring system 10 of the present invention requires two arm devices 12 to prevent impact of the watercraft with the dock, the simple connections allow use of the system at any mooring site having a conventional mooring ring or similar securing point without requiring installation of a specialized bracket.

Figure 1:
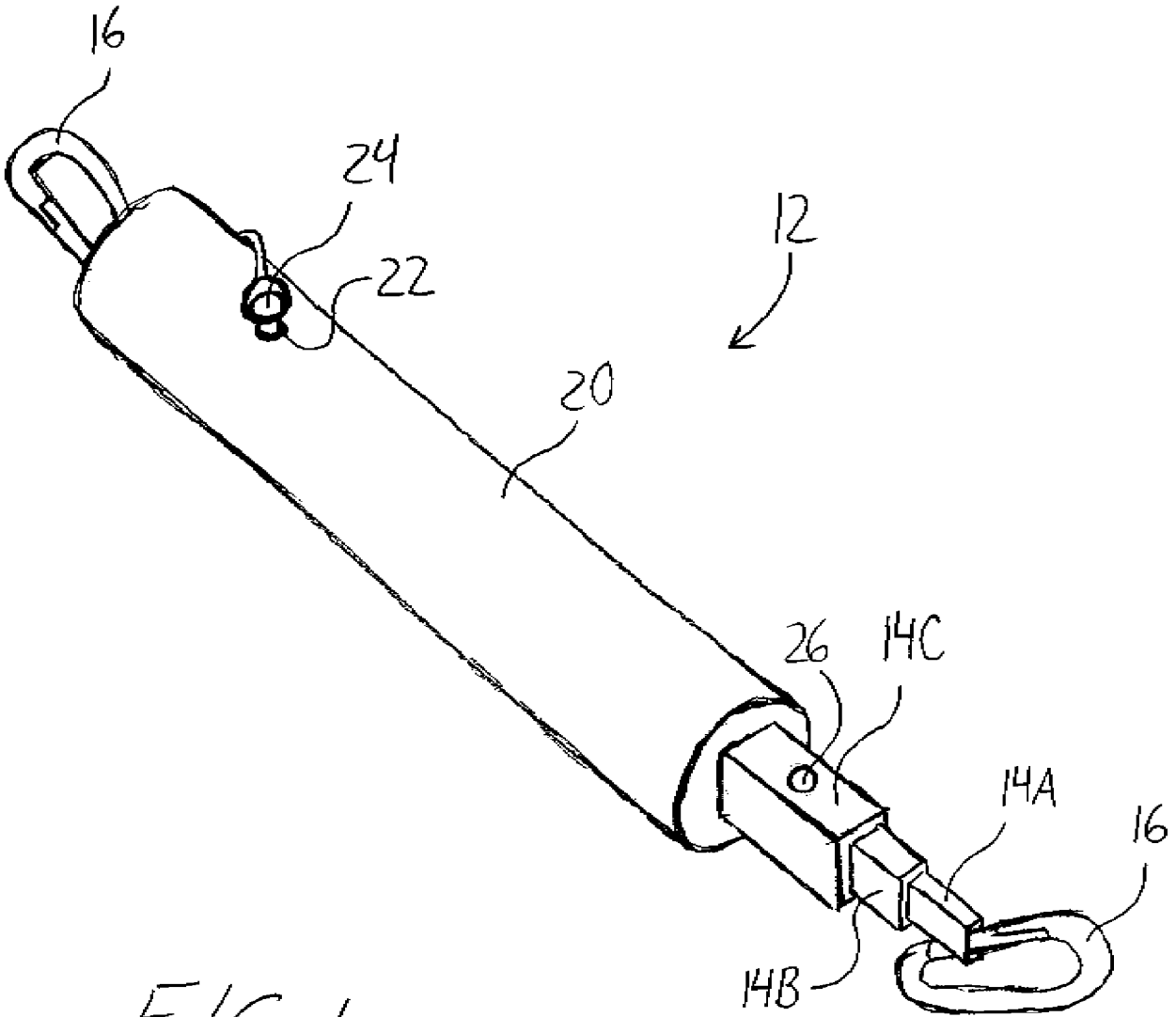
FIG. 1 is a perspective view of an arm assembly of a mooring system according to the present invention with the arm assembly in a collapsed state for storage.

The arm device is made up of concentrically arranged tubular sections to allow telescoping between the collapsed state of FIG. 1 and the extended state of FIG. 2. This improves the portability of the system by allowing a reduction of its size for storage and transport. As shown in the Figures, this allows use of the system with personal watercraft on which storage space is limited. Each arm 12 features three tubular sections 14A, 14B and 14C of subsequently increasing cross-sectional size. The smallest section 14A fits within the middle section 14B, which in turn fits within the largest section 14C. In the collapsed storage state of FIG. 1, each of the smallest and middle tube sections protrudes outward from within the next largest tube section to provide a manually pullable section for telescoping outward to the extended state of FIG. 2.

At opposite ends of the arm device 12 there is provided connectors 16, one secured to the smallest tube section 14A and one secured to the largest tube section 14C. As shown in the Figures, the connectors 16 may be carabiners to provide quick and easy connection and disconnection of the system. Any connector suitable for lockable or sufficiently biased-closed engagement with a dock ring or other securing point may be used.

At least one layer of padding 20 is provided extending about the largest tube portion 14C to create a padded portion of the arm device's length that will come into contact with the watercraft 70 during use. The padding 20 prevents damage to the watercraft that may occur if the watercraft came into direct contact with the metal tube section. The padding 20 may extend past the end of the largest tube section 14C to extend about the connector 16 supported thereat along at least a portion of the connector's length to better protect the watercraft from damage due to direct exposure to hard components of the arm device 12. The padding may be foam, rubber or other material known to be suitable for cushioning impact.

A through-hole 22 extends through the padding 20, largest tube section 14C, middle tube section 14B and smallest tube section with the arm device 12 in the collapsed state of FIG. 1 to allow locking by means of a pin 24 blocking telescoping of the sections. In the extended state of FIG. 2, another through-hole 26 extends through the largest tube section 14C and middle tube section 14B to prevent relative movement therebetween by means of a pin 24 passed through the hole 26. Similarly, a further through-hole 28 extends through middle tube 14B and smallest tube 14A in the extended state to receive a pin 24 to block relative sliding therebetween. The locking pins 24 may, for example, be wirelock pins as illustrated in the Figures.

FIGS. 3 and 4 show the system 10 of the present invention in use to moor a personal watercraft 70 to a dock 80. The arm devices 12 have been extended to their use state shown in FIG. 2 from a state in which they were collapsed for compact storage. Each arm device 12 has been connected between a respective mooring ring 82 hanging over the water 90 on the side of the dock 80 and a respective connecting ring 72 protruding outward from the hull 74 of the watercraft 70. In the arrangement of FIGS. 3 and 4, the arms 12 have been connected to opposite ends of the watercraft 70. Many conventional personal watercraft include connection rings 72 at the front end 76 and rear end 78 thereof. FIG. 3 shows the system 10 in a free state wherein the watercraft 70 is oriented such that its longitudinal axis extends generally along the dock 80 at a distance outward therefrom and positioned to be generally centered between the mooring rings 82. The straight line distance between the mooring rings 82 on the dock 80 is slightly greater than that between the connection rings 72 on the watercraft so that the arm devices 12 angle slightly toward one another away from the dock toward the watercraft. In this state, the arms 12 are free to pivot horizontally in response to movement of the watercraft under the effect of waves, wakes or other disturbances in the water 90.

FIG. 4 shows the watercraft, dock and mooring system of FIG. 3 where the arm devices 12 have undergone sufficient horizontal pivoting in a counter-clockwise direction to put the mooring system 10 into a bound state where further pivoting in that direction is blocked. The padded portion 20 of the arm device 12 connected to the front end 76 of the watercraft 78 has come into contact with the hull 74 of the watercraft at the front end due to relative pivoting between the arm device and watercraft about the connection formed by the carabiner 16 and the connection ring 72 at the front end 76. Due to the horizontal motion of the system being like that of a four-bar linkage formed by the dock, arms and watercraft, this contact between the watercraft and arm device blocks further motion of the watercraft along its path in the direction associated with counter-clockwise pivoting of the arms. This prevents the watercraft from colliding with the dock 80. The watercraft 80 however remains free to travel along its path in the opposite direction along its path, thereby causing the arms to pivot clockwise about the mooring rings 82. Although not shown in the Figures, it should be appreciated that a similar binding effect occurs should the arms undergo sufficient pivoting in a clockwise direction about the mooring rings 82 from the free state shown in FIG. 3, except that the contact occurs between the other arm and the rear end 78 of the watercraft.

FIGS. 5 and 6 are similar to FIGS. 3 and 4 respectively, except that both arms 12 are connected to the rear end 78 of the watercraft 70 at connection rings 72 extending rearward therefrom at points inward from the sides of the watercraft. In the free state of the mooring system shown in FIG. 5, the watercraft is oriented such that its longitudinal axis is generally perpendicular to the dock 80 and generally horizontally centered between the mooring rings 82. Again, the straight line horizontal distance between the mooring rings 82 is slightly greater than that between the connection rings 72 being used to connect the arms 12 such that the arms angle slightly toward each other moving away from the dock 80.

FIG. 6 shows the system of FIG. 5 having reached a binding state under sufficient horizontal pivoting of the arms 12 about the mooring rings 82 to bring one of the arms into contact with the rear end 78 of the watercraft to block further motion of the watercraft toward the dock 80. Although FIG. 6 shows the arms 12 having undergone clockwise pivoting from the free state of the system shown in FIG. 5, it should be appreciated that a similar binding state is reached under sufficient counter-clockwise pivoting to bring the other arm into contact with the rear end 78 of the watercraft. It should be appreciated from FIGS. 3 to 6 that the mooring system 10 of the present invention can work whether the two arm devices 12 are connected to opposite ends or a common end of the watercraft 70.

Figure 7:
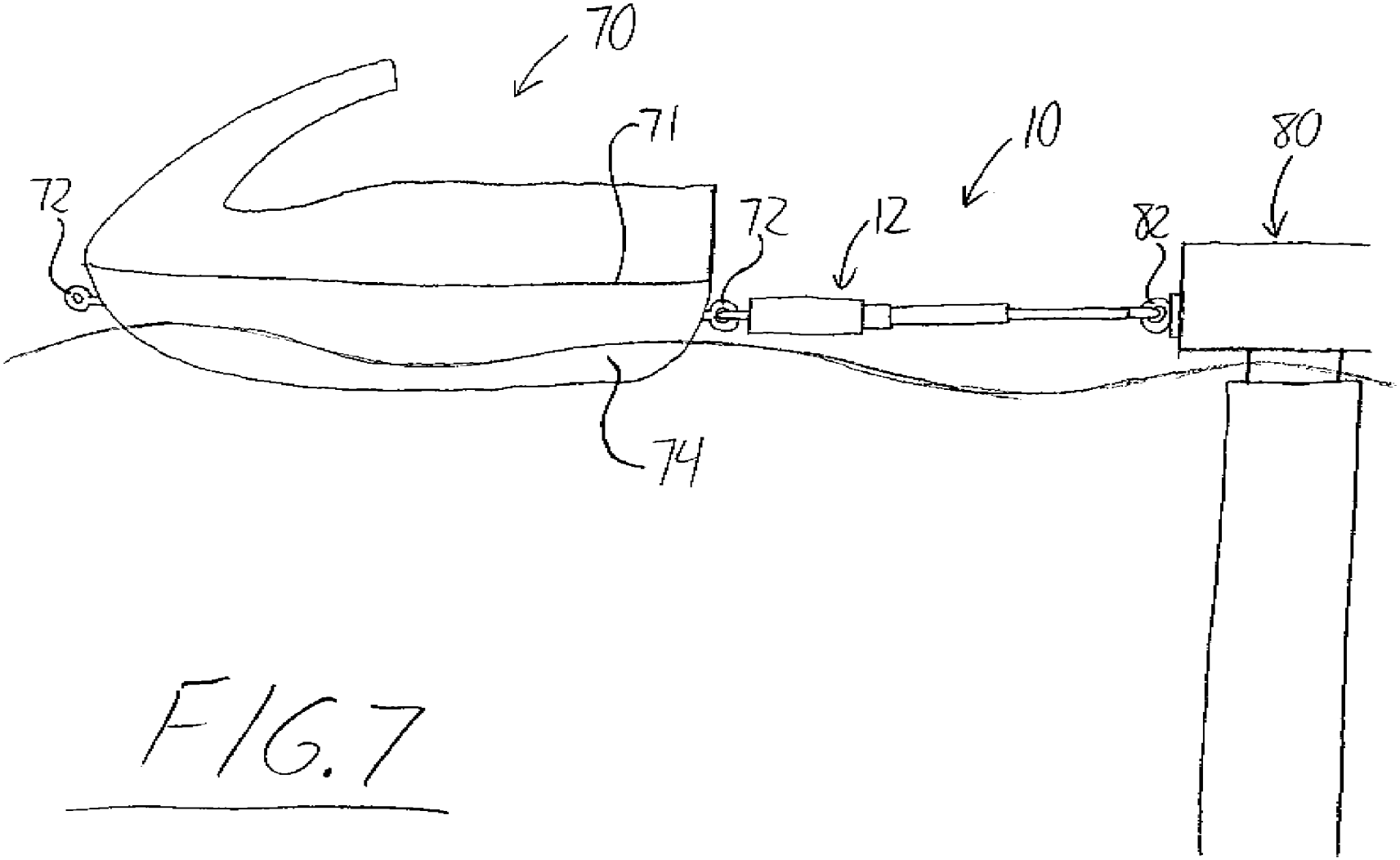
FIG. 7 is a side elevational view of FIG. 5.

FIG. 7 shows the arm devices 12 as being connected to the watercraft 70 just below an upper edge 71 of the hull 74. As the mooring system 10 relies on contact being made between the padded portions of the arm devices and the watercraft 70, the arm devices 12 must be connected between the watercraft 70 and dock 80 at an orientation in which the portion having the padding 20 is supported at an elevation somewhere within the height profile of the watercraft that will ensure contact with the watercraft when the mooring system 10 binds. This differs from prior art systems relying on mounting brackets on the dock or watercraft to block or limit motion of the watercraft toward the dock in which the mooring arm connects to the watercraft atop the deck thereof. From the figures, it should also be appreciated that the cooperation of a carabiner and a mooring ring will not only provide the horizontal pivoting needed to bind the system to prevent impact between the watercraft and dock, but will also allow vertical pivoting so that the watercraft is allowed to rise and fall with waves, wakes, tides and other water level disturbances without straining the arms.

Although shown in the Figures as being used to secure watercraft to a dock while preventing collision therewith, the system can also be used in other locations, for example in a body of water near the shore line thereof in the absence of a dock. Securing poles, such as cork screw tie downs commonly used to tie up dogs in an open space, can be screwed into the ground. The system can then be clipped to the securing poles to prevent the watercraft from drifting ashore. Docks or structures not having mooring rings can be easily converted to a mooring site through the installation of readily available and affordable rings without the need for specialized mooring arm mounting brackets. Such anchors may be provided as part of a kit including a pair of the arm devices. Although rings are shown as mooring site connectors, it should be appreciated that bar-like structures of small enough to diameter for engagement with a carabiner or similar connector may allow sufficient vertical and horizontal pivoting for use with the mooring system of the present invention.

This design is not restricted to any one kind, or one size of watercraft, nor is it restricted to three pieces of tubing. A non-collapsible version of the system would be capable of providing the binding function to prevent watercraft and dock impact, though with a decrease in portability. Arms with as few as two pieces of tubing or more than three pieces would also be enough to ensure that the system is collapsible. The devices can be made to various sizes and with various numbers of pieces of tubing to accommodate various sizes of watercraft. Watercraft not previously equipped with suitable attachment points for the arms of the system may be modified by those of skill in the art to install a suitable connector. For example, the pair of arm devices may be sold in a kit including connectors attachable to an unequipped watercraft. Materials other than rectangular metal tubing may be used to construct the arm devices of the system.

It should be appreciated that the further the arms are angled from an axis perpendicular to the dock edge 84, the closer the watercraft is to the edge. While the distance between the points at which the system connects to the dock can certainly be varied, it is recommended that the angle of the devices not be too severe. If the angle is too severe, there is a possibility that the watercraft could contact the dock before the binding action is allowed to occur.

The foam-covered end of the device should always be clipped to the watercraft rather than to the dock. This protects the surface of the watercraft from any damage that could be caused by the metal tubing contacting the watercraft surfaces. During transport, the system should always be properly secured to the watercraft to avoid possible damage or injury in the event of rough water or other movements that would cause the system to move from storage. The arms of the system when not being used for mooring can serve other useful purposes, for example to act as tow bars for a land vehicle such as a snowmobile or ATV. As such, the present invention can be marketed for various applications.

CONSTRUCTION OF THE DETAILED EMBODIMENT

The system features sixteen separate pieces that are combined to complete two separate extendable, retractable, portable watercraft mooring devices. The following description explains the construction of one of the devices. The present invention requires two of these devices to be used in a cooperating manner in the mooring of the watercraft. The second device is identical to the first.

Three pieces of metal tubing of suitable size are chosen such that the smallest piece can be placed inside the middle sized piece, which in turn can be slid inside the largest piece. A hole is drilled through one sidewall near one end of each of the smallest and largest pieces of tubing. A carabiner is secured to each of the smallest and largest pieces of tubing by opening it and passing it through the hole provided in the one sidewall to close about the portion of that wall left between the hole and the end of the piece of tubing. The tubing is telescopically assembled to dispose the carabiners at opposite ends of the device. A piece of foam is wrapped completely around the largest piece of tubing and secured thereto. The foam covers a majority of the length of the largest piece of tubing and protrudes partially over the carabiner clipped thereto. A hole is drilled through the foam and all three pieces of tubing while they are retracted substantially one inside the other. The pieces of tubing are then telescopically extended but not fully withdrawn from one another. Holes are drilled through the overlap between the largest and middle tubular pieces and the overlap between the middle and smallest tubular pieces.

The above noted process is repeated to create a second identical device. The devices are completed by providing two locking pins for each device, used for locking the pieces of metal tubing together as explained below.

Storage Mode

In the storage mode, each device has its pieces of tubing retracted one substantially inside the other to collapse the device to a smaller overall length. Through alignment of the pieces of tubes, this reopens the hole drilled through the foam and all three pieces. One of the locking pins is placed through this now-open hole to block relative sliding movement of the pieces of tube. This secures the pieces of tubing together in a relatively small package suitable for easy storage and transportation, even on small watercraft.

Extended Mode

With the locking pin previously inserted for transition into the storage mode removed, each device can be telescopically extended. So extended, the holes at the overlaps between the tubular pieces are reopened to allow the insertion of the locking pins. This allows the three tubular pieces of each device to be clipped together by the two respective locking pins with the device extended to the fullest length for use in mooring a watercraft.

Installation

In the extended mode, the system, which consists of two identical devices, is clipped to the rear and the front of the watercraft. One device, after being clipped to the front of the watercraft, is then clipped to a mooring bracket on the dock. The second device, after being clipped to the rear of the watercraft, is then also clipped to a separate mooring bracket on the dock.

Function

Once both parts of the device are in place, the watercraft is kept away from the dock by the binding action created as the watercraft moves back and forth in the along the dock. As the watercraft moves rearward, the system will bind against the rear of the watercraft. This will halt the movement of the watercraft before it can contact the dock. The same result occurs when the watercraft moves forward. The system will bind against the front of the watercraft and halt the movement of the watercraft before it can contact the dock. The system can also be clipped to two separate points at the rear of the watercraft and then to two separate points on the dock. As the watercraft drifts to the left or right, it again binds against the devices before it can contact the dock. This unique binding action distinguishes the present invention from other devices that are fastened to the dock with specialized mounting brackets.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A mooring kit in combination with a watercraft, the kit comprising two arm assemblies, each arm assembly comprising:

a longitudinal element having opposite first and second ends;

a first connector at the first end, the first connector being arranged to allow horizontal and vertical pivotal motion of the arm assembly; and a second connector at the second end opposite the first connector, the second connector being arranged to allow horizontal and vertical pivotal motion of the arm assembly;

the arm assemblies being connected to the watercraft by engagement of the first connectors with horizontally spaced receivers on the watercraft and being connected to a body separate and distinct from the watercraft only by engagement of the second connectors with two horizontally spaced securing points defined on the body in a vertical plane spaced from the watercraft with an end portion of each arm assembly, extending from the first end thereof toward the second end, disposed in an elevation range defined by a height profile of the watercraft to block horizontal pivoting of the arm assemblies, in each of clockwise and counterclockwise directions, sufficient to bring the watercraft to the vertical plane in which the securing points lie by contact between the watercraft and the end portion of a respective one of the arm assemblies.

2. The combination according to claim 1 wherein the longitudinal element of each arm assembly is extendable and retractable between an extended state and a collapsed storage state.

3. The combination according to claim 2 wherein the longitudinal element of each arm assembly comprises a plurality of telescopically arranged hollow tube sections lockable in each of the extended and collapsed states.

4. The combination according to claim 3 wherein the telescopically arranged hollow tube sections are lockable by cooperation of a locking pin with holes in the tube sections that align in the extended and collapsed states.

5. The combination according to claim 3 wherein the end portion of each arm assembly comprises padding wrapped about a cross-sectionally largest one of the hollow tube sections.

6. The combination according to claim 1 wherein each of the first and second connections comprises a quick-release connection.

7. The combination according to claim 6 wherein each quick-release connection comprises a carabiner.

8. The combination according to claim 1 wherein the end portion of each arm assembly has padding wrapped thereabout.

9. The combination according to claim 1 wherein the arm assemblies are connected to the watercraft at opposite ends thereof.

10. The combination according to claim 1 wherein the arm assemblies are connected to the watercraft at a common end thereof.

11. The combination according to claim 1 wherein the watercraft is a personal watercraft.

12. The combination according to claim 1 wherein the horizontally spaced receivers defined on the watercraft, to which the arm assemblies are connected at the first connectors thereof, are mounted on a hull of the watercraft.

13. The combination according to claim 1 wherein the arm assemblies and the watercraft are arranged to allow limited horizontal pivoting of the arm assemblies, in each of the clockwise and counterclockwise directions, to allow limited movement of the watercraft toward the vertical plane before contact of the watercraft with the respective arm assembly blocks further horizontal pivoting in the same direction to prevent the watercraft from reaching the vertical plane.

14. The combination according to claim 1 wherein the arm assemblies, connected to the receivers on the watercraft and the securing points in the vertical plane, are non-parallel.

15. The combination according to claim 1 wherein the first connector of each arm assembly is connected to the body on which the securing points are defined only by connection of said arm assembly, at the second connector thereof, to a respective one of the securing points.

16. A method of mooring a watercraft, the method comprising the steps of:

providing first and second horizontally spaced connection points on the watercraft;

providing first and second securing points on a body separate and distinct from the watercraft, the securing points being horizontally spaced within a vertical plane;

connecting a first arm assembly to the watercraft at the first connection point thereon and connecting the first arm assembly to the body at only the first securing point thereon such that said first arm assembly is pivotable in vertical and horizontal directions at the first connection and securing points;

connecting a second arm assembly to the watercraft at the second connection point thereon and connecting the second arm assembly to the body at only the second securing point thereon such that said second arm assembly is pivotable in vertical and horizontal directions at the first second connection and securing points; and blocking horizontal pivoting of the arms in each one of clockwise and counterclockwise directions sufficient to bring the watercraft to the vertical plane in which the securing points lie by contact between the watercraft and a respective one of the first and second arm assemblies.

17. The method according to claim 16 further comprising extending each arm assembly from a collapsed storage state before connecting the arm assembly.

18. The method according to claim 16 further comprising providing each arm assembly with padding about a portion thereof before connecting each arm assembly to prevent damage to the watercraft during contact with the arm assembly.

19. The method according to claim 16 comprising the step of allowing limited horizontal pivoting of the arms to horizontally move the watercraft without reaching the vertical plane in which the securing points lie before blocking further horizontal pivoting of the arms by contacting the watercraft with the respective one of the first and second arm assemblies.

20. The method according to claim 16 wherein the steps of connecting the first and second arm assemblies between the connection points on the watercraft and the securing points comprise connecting the arm assemblies in an arrangement in which the arm assemblies are non-parallel.

* * * * *